US005230106A

United States Patent [19]

Henkin et al.

[11] Patent Number: 5,230,106

[45] Date of Patent: Jul. 27, 1993

[54] HAND HELD TAP WATER POWERED WATER DISCHARGE APPARATUS

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 688,292

[22] Filed: Apr. 22, 1991

[51] Int. Cl.[5] ..... A61H 9/00; A47K 3/22

[52] U.S. Cl. ..... 4/541.4; 4/567; 4/615; 128/66

[58] Field of Search ..... 4/541, 542, 567, 568, 4/570, 615; 239/428.5, 443, 446, 447, 525; 128/65, 66

[56] References Cited

U.S. PATENT DOCUMENTS

| | | | |
|---|---|---|---|
| 3,528,411 | 9/1970 | Clements | 128/66 |
| 3,581,998 | 6/1971 | Roche | 239/525 X |
| 3,802,422 | 4/1974 | Hurst | 128/66 |
| 3,979,096 | 9/1976 | Zieger | 4/615 X |
| 4,211,368 | 7/1980 | Legros et al. | 239/428.5 X |
| 4,441,488 | 4/1984 | Macabee | 128/66 |
| 4,458,676 | 7/1984 | Pileggi | 4/568 X |
| 4,629,125 | 12/1986 | Liu | 239/443 |
| 4,689,839 | 9/1987 | Henkin et al. | 4/542 |
| 4,715,071 | 12/1987 | Henkin et al. | 4/542 |
| 4,726,080 | 2/1988 | Henkin et al. | 4/542 |
| 4,793,332 | 12/1988 | Klein | 128/66 |
| 4,907,744 | 3/1990 | Jousson | 239/447 X |
| 4,926,510 | 5/1990 | Watkins | 4/542 |
| 4,933,999 | 6/1990 | Mikiya et al. | 4/568 |
| 5,054,474 | 10/1991 | Jacob et al. | 128/66 |
| 5,093,942 | 3/1992 | Lang | 4/542 |
| 5,093,943 | 3/1992 | Wei | 4/567 X |

FOREIGN PATENT DOCUMENTS

| | | | |
|---|---|---|---|
| 3835143 | 4/1990 | Fed. Rep. of Germany | 4/615 |
| 3838242 | 5/1990 | Fed. Rep. of Germany | 4/567 |
| 0569136 | 11/1957 | Italy | 4/615 |

*Primary Examiner*—William A. Cuchlinski, Jr.
*Assistant Examiner*—John L. Beres
*Attorney, Agent, or Firm*—Freilich, Hornbaker & Rosen

[57] ABSTRACT

A water discharge apparatus configured to be held in a user's hand, and powered by a tap water source for selective operation in a continuous shower spray mode, a pulsed shower spray mode, or a submergible hydromassage mode.

27 Claims, 10 Drawing Sheets

96
40
160
156
144
148
150
4
142
140
158
152
90
92
3
70
72
88
3
54
94
130
4
62
300
54
62
64

72
86
71
98
74
88
84
76
100
70
100
80
78
82
54

110
112
104
118
106
88
114
116
102
70
80
82
54

160
96
6
7
226
220
225
220
144
387
228
142
40
156
283
230
206
350
286
140
208
196
360
204
180
200
158
224
282
6
150
11
152
7
94
224
202
94
202
340
10
190
278
300
300
320
322
200
220
306
130
324
190
344
304
200
220
302

54

54
11
62
10

16
500
502
423
430
17
18
442
444
448
446
404
408
400
506
406
420
492
493
474
452
453
440
478
462
482
464
494
476
470
490
480
496
441
402
468
472
484
467
504
460
498
466
422
440
448
494
190
62
54
15
406
430
408
478
423
496
467
436
466

HAND HELD TAP WATER POWERED WATER DISCHARGE APPARATUS

FIELD OF THE INVENTION

This invention relates to water discharge apparatus configured to be held in a user's hand, and powered by a tap water source for selective operation in a continuous shower spray mode, a pulsed shower spray mode, or a submergible hydromassage mode.

RELATED APPLICATIONS

Applicants' copending application no. 688,043 filed Apr. 19, 1991, discloses an electric pump powered hand held hydrotherapy apparatus.

BACKGROUND OF THE INVENTION

Many different structures are known in the prior art for discharging shower water sprays and massage water flows. For example only, many different hand held water discharge heads widely marketed through plumbing and hardware stores by various manufacturers, e.g. Teledyne Water Pik, are capable of selectively discharging either a continuous or pulsating shower spray. Other devices, primarily powered by electric pumps for use in hydrotherapy water tubs, are available for discharging water streams beneath the water surface for impacting and massaging a user's body, e.g. the HYDROWAND marketed by HydroAir Industries.

Still other devices for discharging water streams for massaging a user's body are disclosed in Applicants' following U.S. patents and the references cited therein:

| | |
|---|---|
| 4,679,258 | 4,731,887 |
| 4,689,839 | 4,763,367 |
| 4,692,950 | 4,813,086 |
| 4,715,071 | 4,825,854 |
| 4,726,080 | 4,965,893 |
| 4,727,605 | 4,982,459 |

The foregoing patents primarily disclose electric pump powered assemblies intended for mounting in a water tub wall for discharging a water stream through a discharge orifice. Some of the disclosed assemblies are configured so that the discharge orifice travels along a defined or random path so that the stream impacting against the user's body describes an area. U.S. Pat. Nos. 4,689,839 and 4,726,080, whose disclosures are, by reference, incorporated herein, describe tap water powered hydrotherapy apparatus in which a water stream is discharged from a discharge orifice into a tub below the water surface and energy derived from the supplied tap water causes the discharge orifice to move along a path of travel.

SUMMARY OF THE INVENTION

The present invention is directed to a tap water powered water discharge apparatus selectively operable in a continuous shower mode, a pulsed shower mode, and a submergible hydromassage mode.

Apparatus in accordance with the invention includes a sealed housing preferably configured to be held in a user's hand and mounted on the free end of a flexible tap water supply hose. A user operable control member controls a mode selector valve which determines the mode of the water discharged from the housing.

Apparatus in accordance with the invention includes a jet pump which, in the hydromassage mode, uses the supplied tap water to entrain tub water. In accordance with a preferred embodiment, the combined tap-tub water flow is used to entrain air to form a water-air stream, which is discharged from the housing for massaging a user's body.

In accordance with a first embodiment of the invention, the housing defines a fixed discharge orifice. In accordance with a second embodiment, the housing defines a discharge orifice which moves along a travel path as the water stream is discharged therefrom.

In accordance with a further aspect of the invention, at least one protuberance extends from the housing proximate to the discharge orifice for placement against a user's body to space the discharge orifice therefrom to prevent occlusion of the water stream.

In accordance with a valuable feature of the second embodiment, the protuberance is configured with a substantially smooth surface for engaging the user's body. As the discharged water stream propels the discharge orifice along its travel path, forces reacting to the discharge act on the unit to move the protuberance and thus mechanically massage the user's body to supplement the hydromassage produced directly by the discharged water stream.

In accordance with a still further aspect of the invention, a deck mounting subassembly is provided for coupling a tap water supply manifold to the flexible supply hose leading to the hand held housing. The subassembly, adapted to be mounted in a horizontal deck of a water tub, includes a container, e.g. a bag of flexible plastic material, for accommodating the supply hose and for catching water drippings from the hose after the unit is used in the submerged hydromassage mode.

DETAILED DESCRIPTION

Figure 1:
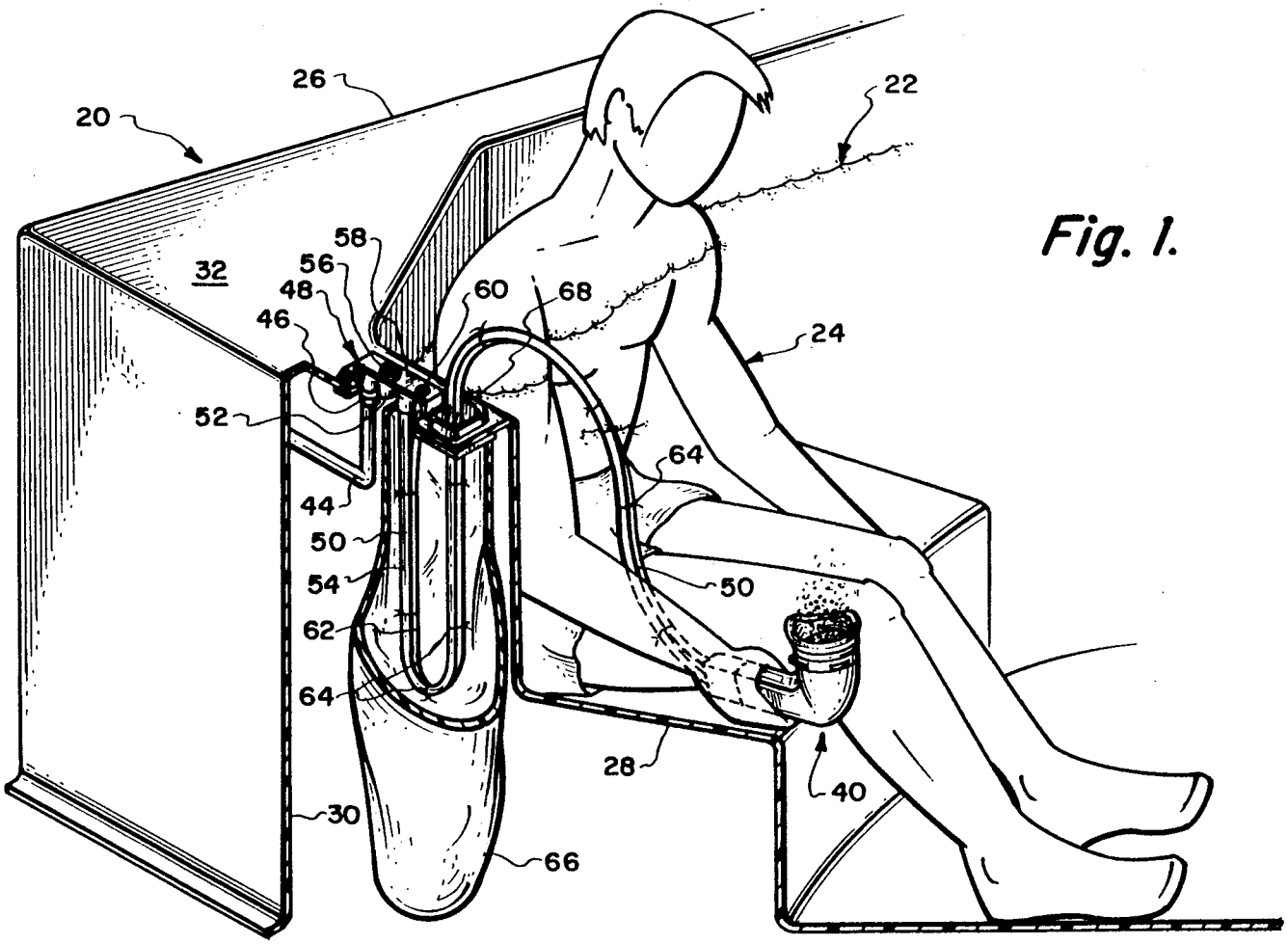
FIG. 1 is an isometric view of a user in a water tub depicting a typical installation of an embodiment of the present invention.

Attention is now directed to FIG. 1 which illustrates an exemplary water tub 20 for accommodating a pool of water 22 in which a user 24 can sit. The water tub includes a wall 26 essentially comprised of an inner wall portion 28, an outer wall portion 30, and a deck wall portion 32.

The present invention is primarily directed to a hand held unit 40 designed to enable the user 24 to selectively discharge either a continuous shower spray, a pulsed shower spray, or a hydromassage water stream. In contrast to many electric pump driven hydromassage units known in the prior art, embodiments of the present invention are driven by pressurized tap water supplied from a conventional residential or commercial tap water source. For purposes of explanation herein, it will be assumed that pipe 44 delivers fresh tap water at coupler 46.

In accordance with one aspect of the present invention, a deck mount subassembly 48 is provided for efficiently coupling the tap water supply pipe 44 to a flexible hose 50, preferably having two lumens for respectively delivering tap water and air to the hand held unit 40. The subassembly 48 is intended to mounted in an opening in deck 32, as shown in FIG. 1 The subassembly 48 includes a short pipe section 52 having an inlet nipple intended to be coupled by coupler 46 to supply pipe 44. An outlet nipple on pipe section 52 is coupled to a water lumen 54 of flexible hose 50. Flow through the pipe section 52 from supply pipe 44 to water lumen 54 can be controlled by the user via valve control knob 56 mounted on the subassembly plate 58. An air hole 60 formed in the plate 58 communicates with an air lumen 62. The water lumen 54 and air lumen 62 are depicted as being bound together along their length by ties 64. Together, the lumens 54 and 62 form the aforementioned flexible hose 50 extending to the hand held unit 40. More specifically, note that the lumens 54 and 62 are depicted as initially descending from the pipe section 52 and air hole 60 below the plate 58 into a container 66, e.g. a bag formed of flexible plastic material. The lumens 54 and 62 emerge from the bag through opening 68 in plate 58.

As depicted in FIG. 1, when the hand held unit 40 is submerged below the surface of pool 22, as is typical of operation in the hydromassage mode, the hose 50 will of course get wet. The bag 66 which accommodates the hose will catch the drippings therefrom. When the unit 40 is not in use, the user will thread the hose 50 back through opening 68 into the bag 66 leaving the handle portion of unit 40 in the opening 68 and with its discharge portion extending above the deck 32.

As previously mentioned, a hand held unit 40 in accordance with the present is selectively operable in a continuous shower mode, a pulsed shower mode, or a hydromassage mode. As will be seen hereinafter, a mode selector valve (FIGS. 10–12) is provided to enable the user to select any one of these three operational modes, as well as an OFF mode.

Figures 2, 3, 3A:
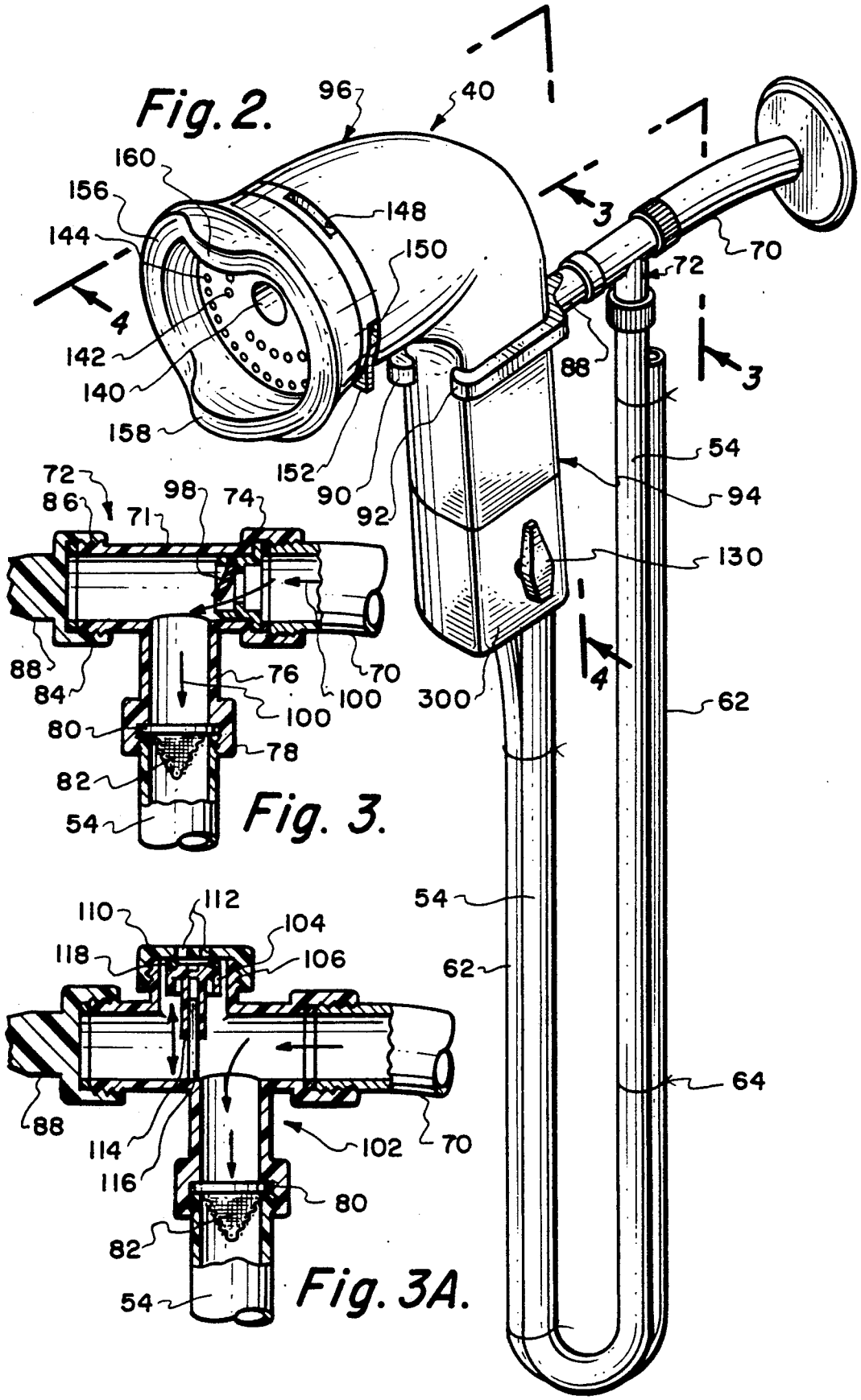
FIG. 2 is an isometric view of an embodiment of the invention in an alternative installation, mounted on a conventional shower supply pipe.
FIG. 3 is a sectional view taken substantially along the plane 3—3 of FIG. 2 depicting an adapter in accordance with invention for facilitating use of the hand held unit with a conventional shower supply pipe.
FIG. 3A is a sectional view depicting an a second adapter which is an alternative to the adapter depicted in FIG. 3.

FIG. 2 illustrates the hand held unit 40 alternatively installed on a conventional wall mounted shower supply pipe 70. A preferred T-shaped adapter 72 is shown for coupling the supply pipe 70 to the hand held unit 40. With particular reference to FIG. 3, note that adapter 72 includes a pipe section 71 having an enlarged internally threaded end 74, defining a supply water inlet, adapted to be threaded on to the externally threaded end of supply pipe 70. Pipe leg 76 extends downwardly in FIG. 3 and retains an internally threaded coupler 78, defining a water outlet, which receives a threaded end of the aforementioned water lumen 54. Preferably, a washer 80 and filter screen 82 are incorporated in the flow passage between the adapter 72 and water lumen 54.

The pipe section 71 is depicted in FIG. 3 as having an externally threaded open end 84. As shown, this open end is sealed by an internally threaded enlarged end 86 of a bracket 88. The bracket 88 at its forward or left end in FIGS. 2 and 3, is bifurcated to define spaced arms 90 and 92. The spacing between the arms 90 and 92 is dimensioned to accommodate the handle 94 of the unit 40 as depicted in FIG. 2. Note that the handle 94 is substantially straight and is connected or formed integral with a head portion 96 of the unit 40.

Note in FIG. 3 that a check valve 98 is incorporated in adapter 72 in the flow path between the fitting inlet 74 and the fitting outlet 78. This check valve is to prevent any flow of water from the pool 22 back into the fresh tap water plumbing, represented by shower pipe 70 in FIG. 2. The check valve 98 opens in response to positive tap water pressure supplied by shower pipe 70, to permit flow therepast in the direction of arrows 100. Check valve 98 will close to prevent any flow in the opposite direction.

FIG. 3A illustrates an adapter 102 which can be used as an alternative to the adapter 72 of FIG. 3. The adapter 102 incorporates an antisiphon valve 104 formed by an externally threaded nipple 106 closed by cap 110 apertured at 112. A valve element 114 is mounted for vertical movement on pin 116. The valve element 114 carries an o-ring 118 capable of sealing the aperture 112 when it is thrust upwardly by water pressure supplied from shower pipe 70. More specifically when shower pipe 70 supplies pressurized tap water, the valve member 114 is forced upwardly to cause o-ring 118 to engage cap 110 seal aperture 112 against water leakage. In the event a suction is formed in the shower pipe 70, the valve element 114 will be drawn downwardly thus permitting the in flow of ambient air through to break the suction and thus prevent a reverse flow from the unit 40 back into the tap water plumbing system represented by shower pipe 70.

Although not explicitly depicted in FIG. 1, it should be understood that a check valve or anti siphon valve as shown in FIGS. 3 and 3A is preferably also incorporated in the pipe section 52 of the mounting subassembly 48.

Before proceeding to a detailed explanation of the internal structure of unit 40, certain aspects of the first embodiment of the invention as depicted in FIG. 2, will be pointed out. Initially, note that a control knob 130 is externally mounted on the handle 94. As will be seen, this control knob 130 operates a mode selector valve (FIGS. 10–12) to define any one of three operational modes or an OFF mode. The unit's head portion 96 defines a series of openings in what otherwise is a sealed housing. More particularly, note opening 140 located centrally on the front face of head portion 96. Opening 140 comprises a discharge orifice which functions to discharge a hydromassage water stream.

A series of smaller openings 142, annularly located around discharge orifice 140 are used to discharge the pulsating shower flow. A series of still smaller openings 144 positioned radially outwardly from the openings 142 are used to discharge the continuous shower flow.

Openings 148 and 150 comprise tub water inlet openings. As will be discussed hereinafter, the tub water inlets 148, 150 communicate with the suction inlet of a jet pump incorporated within the unit 40. Also shown in FIG. 2 is a handle 152 which projects outwardly through tub water inlet 150. As will be seen hereinafter, this handle 152 forms part of an entrainment selector valve which enables the user to cause air to be entrained in the hydromassage water stream discharged from discharge orifice 140.

In addition to the foregoing, it should be noted that the orifice 140 and openings 142, 144 are surrounded by a collar 156 mounted on the front end of head portion 96. Note that the collar 156 is formed with first and second forwardly projecting protuberances 158, 160 which prevent the head portion 96 from being pressed against the user's body in a manner to occlude out-flow.

Figures 4, 10:
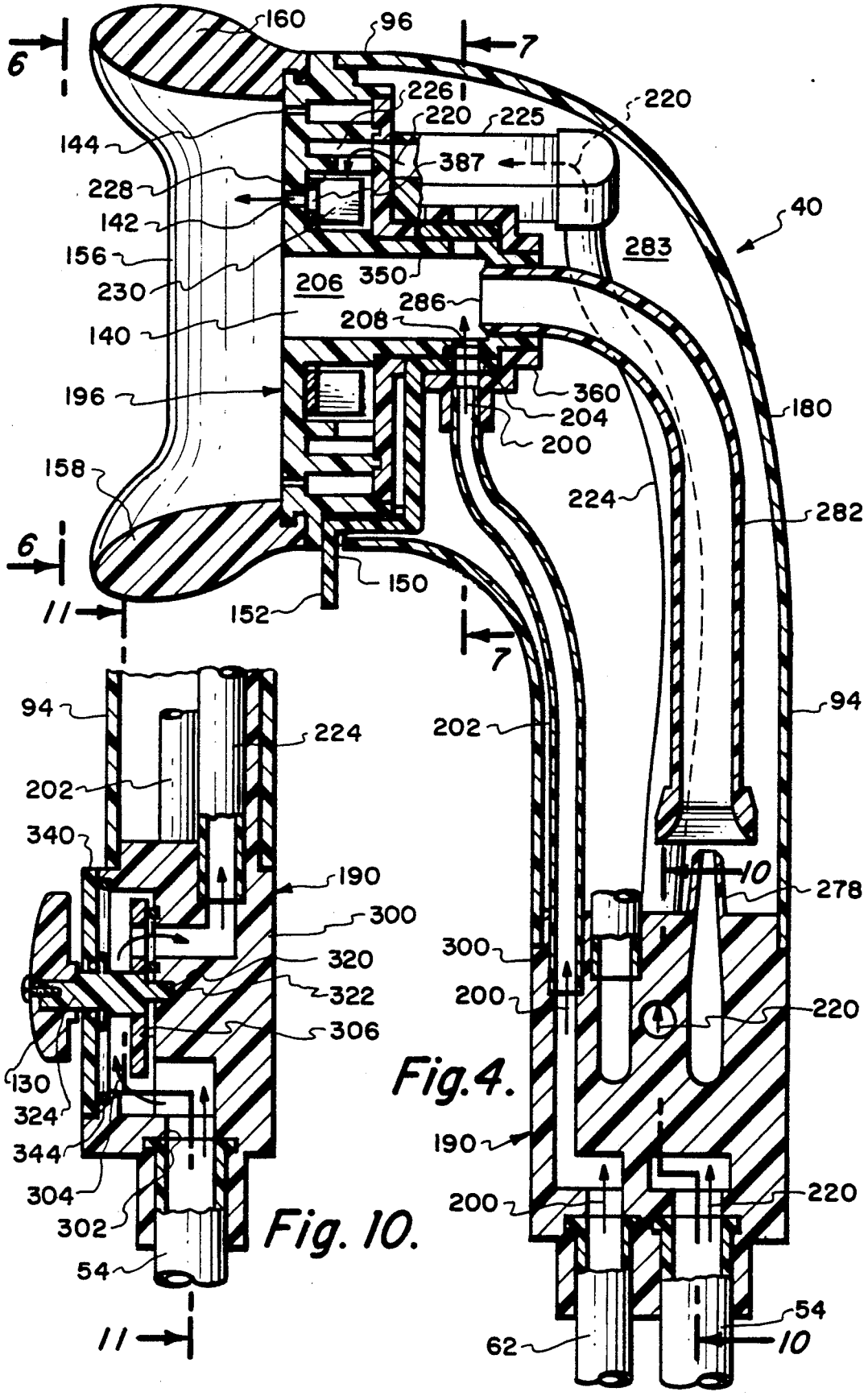
FIG. 4 is a sectional view taken substantially along the planes 4—4 of FIGS. 2 and 7 illustrating a first hand held unit in accordance with the present invention.
FIG. 10 is a sectional view taken substantially along the plane 10—10 of FIG. 4 illustrating a preferred mode selector valve.
Figures 5, 11:
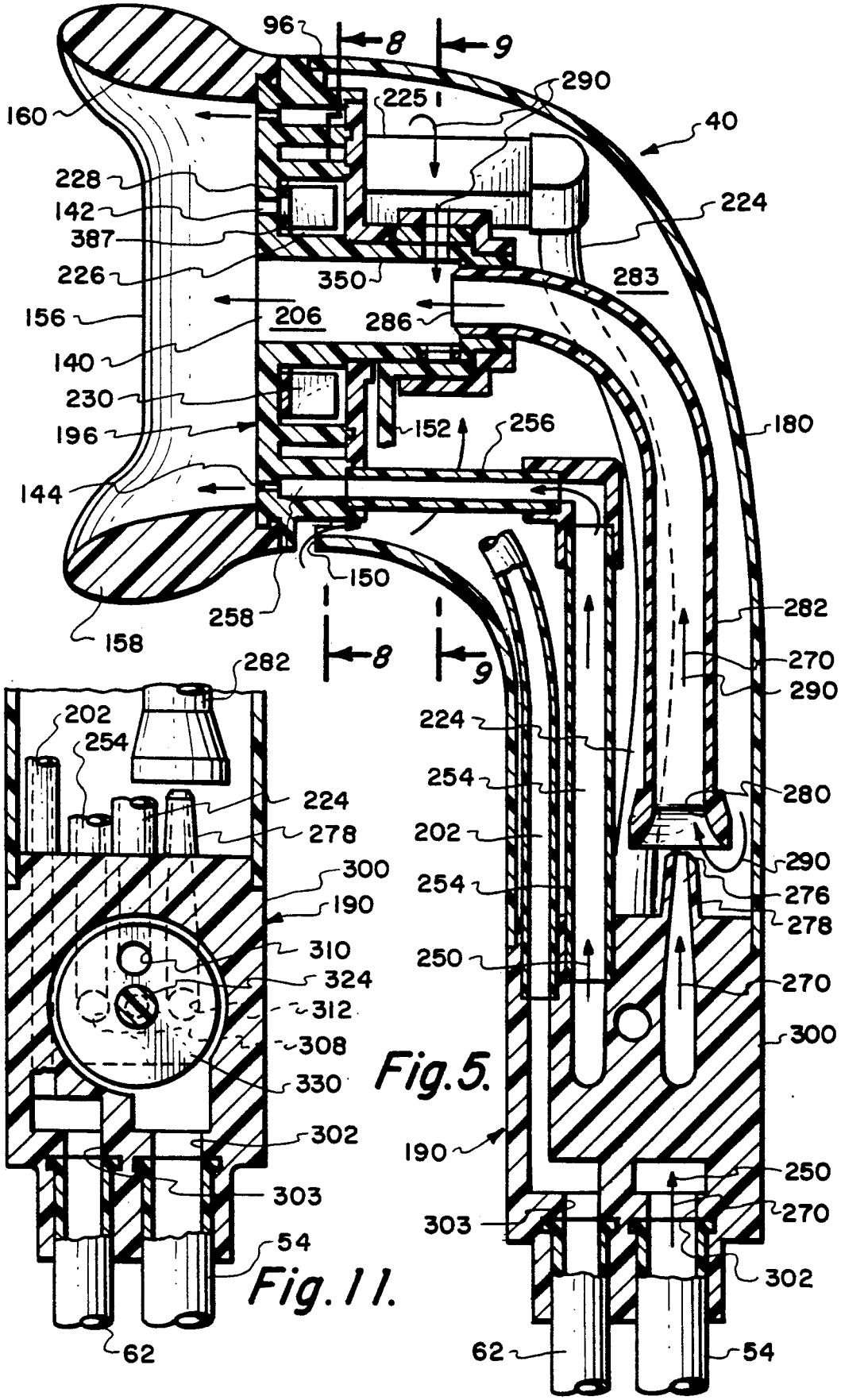
FIG. 5 is a sectional view taken substantially along the plane 5—5 of FIG. 9.
FIG. 11 is a sectional view taken substantially along the plane 11—11 of FIG. 10.
Figure 6:
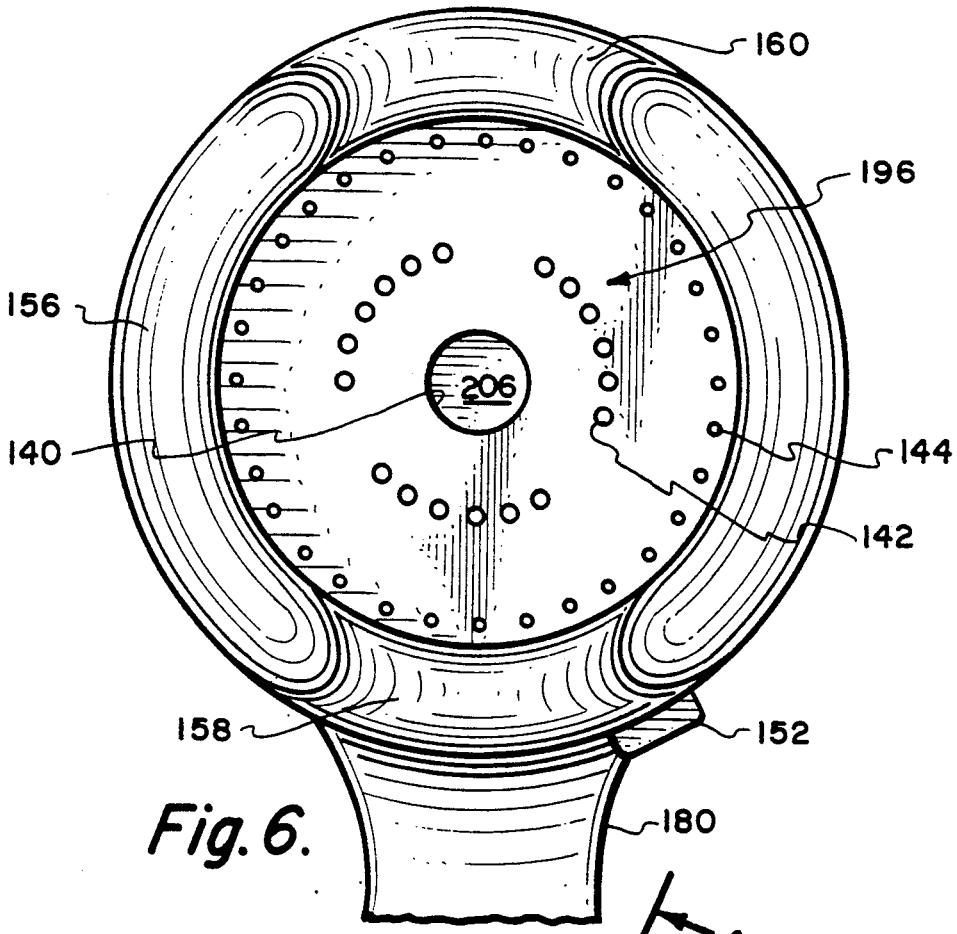
FIG. 6 is a view taken substantially along the plane 6—6 of FIG. 4.

Attention is now directed to FIGS. 4 and 5 which depict sectional views through the hand held unit 40. The unit 40 is essentially comprised of a housing 180 shaped to define the aforementioned handle 94 and head portion 96. As depicted in FIG. 4, the lower end of the handle 94 mates with and accommodates a mode selector valve subassembly 190, best depicted in FIGS. 10–12. The head portion 96 accommodates at its forward end, a flow distribution subassembly 196. Various tubular members to be discussed hereinafter extend through the interior of the housing 180 to couple the mode selector valve subassembly 190 to the flow distribution subassembly 196. Before addressing the structural details of the subassemblies, it will be instructive to observe the general flow paths for air and water for each of the operating modes. With reference to FIG. 4 note flow arrows 200 which depict the flow of air from lumen 62 through the subassembly 190, a tubular member 202, and an entrainment valve member 204, and then into an entrainment cavity 206, via an air port 208. These elements define the air path when the unit is operating in the hydromassage mode and air is to be entrained in the water stream discharged through the discharge orifice 140.

FIG. 4 also shows by directional arrows 220, the water flow for the pulsed shower mode; i.e., from water lumen 54, through mode selector subassembly 190, tubing 224, manifold 226, paddle wheel chamber 228, and aforementioned pulsed shower flow openings 142. As will be seen hereinafter, when this path is selected, the tap water from water lumen 54 flows into the manifold 226 to rotate a paddle wheel rotor 230, mounted for rotation in compartment 228, to repetitively open and close the flow path to the pulsator shower openings 142.

FIG. 5 shows by flow arrows 250, the flow of fresh tap water for the continuous shower mode; i.e. from lumen 54 through mode selector subassembly 190, through tubular member 254 and 256, manifold 258, and then to continuous shower openings 144.

FIG. 5 also shows by flow arrow 270, the flow for the hydromassage mode of operation. In the hydromassage mode, fresh tap water from water lumen 54 moves through the mode selector subassembly 190 and is discharged at the outlet 276 of converging driving nozzle 278 into the converging suction inlet 280 of a mixing tube 282. The driving nozzle 278, together with the mixing tube 282, forms a jet pump, as is described in Applicants' aforementioned U.S. Pat. No. 4,689,839. The fresh water discharged at a high velocity from the driving nozzle 278 into the suction inlet 280 of the mixing tube 282 produces a suction to entrain tub water drawn into the interior chamber 283 of housing 180 via the tub water inlets 148, 150. The mixing tube 282, at its downstream exit 286, discharges a water jet into the aforementioned cavity 206 producing a suction therein. Depending upon the position of the entrainment selector handle 152, the water flow discharged from the mixing tube exit 286 will entrain either air, as represented by the air flow arrows 200 in FIG. 4, or additional tub water as is represented by the arrows 290 in FIG. 5. Tub water can enter the housing chamber 283 via the aforementioned tub water inlets 148, 150. These inlets are located at the forward end of the housing head portion 96 so that the unit is able to function in the hydromassage mode as long as inlets 148 and/or 150 are sufficiently underwater to enable tub water to flow to the suction inlet 280 of the jet pump mixing tube 282.

Figure 12:
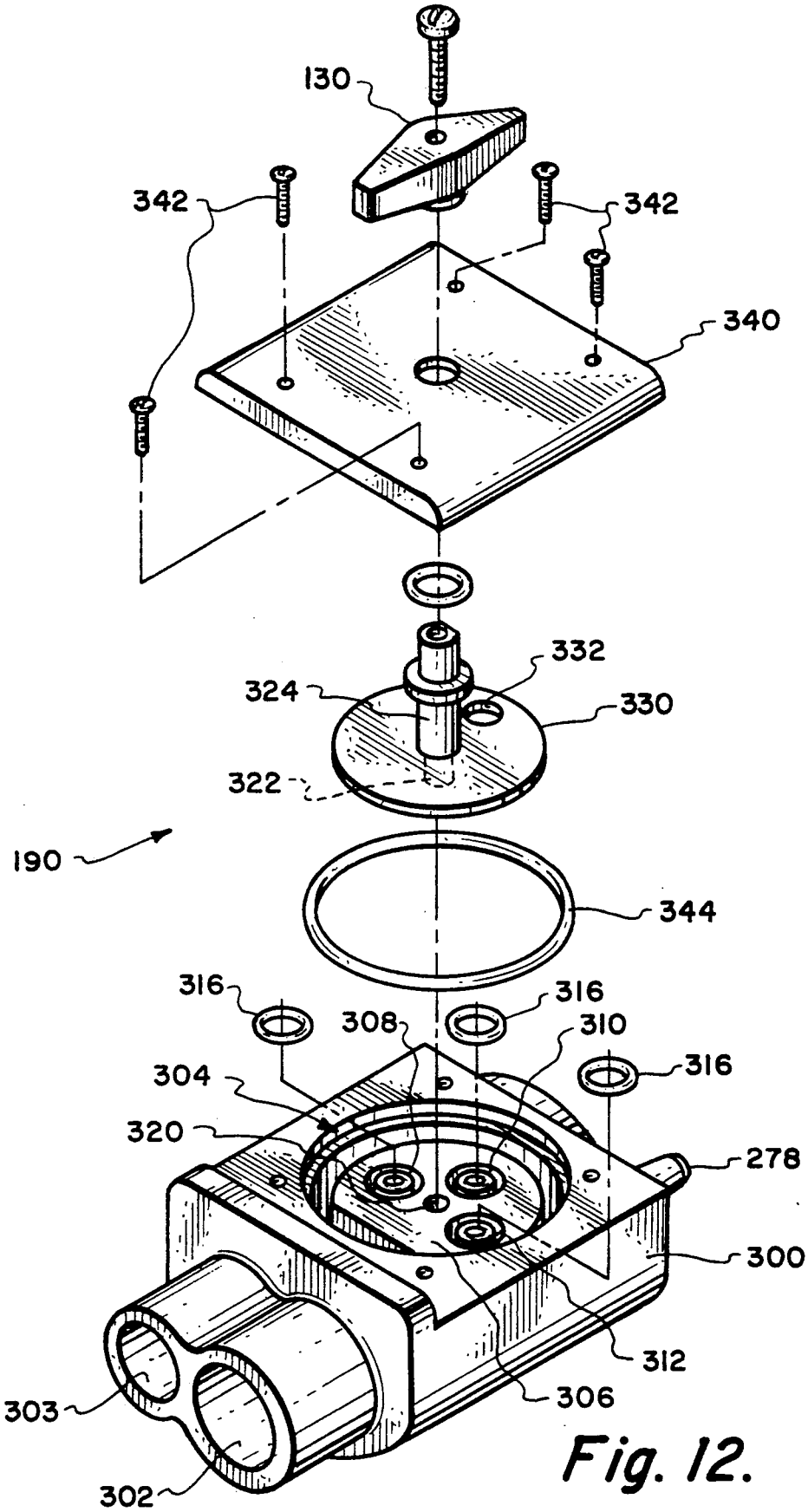
FIG. 12 is an exploded isometric view of the mode selector valve depicted in FIGS. 10 and 11.

With the foregoing explanation in mind, attention is now directed to FIGS. 10–12 which depict in detail a preferred mode selector valve subassembly 190.

The mode selector valve subassembly 190 includes a body portion 300 having a water inlet 302 and air inlet 303 to which the lumens 54 and 62 respectively couple. The inlet 302 opens into a chamber 304 having a floor surface 306. Entrance (inlet) openings 308, 310, and 312 are formed in the floor surface 306 for respectively communicating with the aforementioned tube members 254, 224, and driving nozzle 278 (see FIG. 11). O-rings 316 are preferably provided, receivable in recesses in the openings 308, 310, and 312, as depicted in FIG. 12. The floor 306 of chamber 304 also defines a central hole 320 for receiving the reduced end portion 322 of a shaft 324 to which the aforementioned control knob 130 is secured. Secured to the shaft 324 (FIGS. 10 and 12) is a disk 330 apertured at 332. The shaft reduced end 322 is received in hole 320 for rotation to selectively align aperture 332 with any one of inlets 308, 310, and 312. Additionally, the shaft 324 can be rotated to a fourth or OFF position in which the aperture 332 is not aligned with any of the inlets 308, 310, or 312. A cover plate 340 is provided to cover the chamber 304. More particularly, the cover plate can be fastened to the upper surface (FIG. 12) of body portion 300 by fastening means such as screws 342. An O-ring 344 is preferably mounted in an annular recess in the wall of chamber 304 to prevent leakage.

Although the selector valve subassembly 190 has been depicted in FIG. 12 as being comprised of multiple parts held together by screw fasteners 342, it should be recognized that other types of fasteners or adhesive means could be readily employed in the subassembly 190 as well as in other portions of the unit 40.

From the foregoing, it should be recognized that by rotating the control knob 130, the user 24 will be able to selectively align the aperture 332 with any one of the inlets 308, 310, 312 to supply fresh tap water thereto from water lumen 54 and thus establish the mode of operation. Alignment with inlet 308, communicates the fresh water flow to tubular member 254 to create the continuous shower flow from openings 144 (FIG. 5). Alignment with inlet 310 enables the fresh water flow to traverse tube 224 for introduction into the paddle wheel compartment 228 to produce a pulsating shower flow via openings 142. Alignment of the aperture 332 with inlet 312 supplies the fresh tap water from water lumen 54 to driving nozzle 278 to entrain tub water in mixing tube 282 to discharge a water stream from exit 286 into cavity 206 and then through discharge orifice 140.

Figure 7:
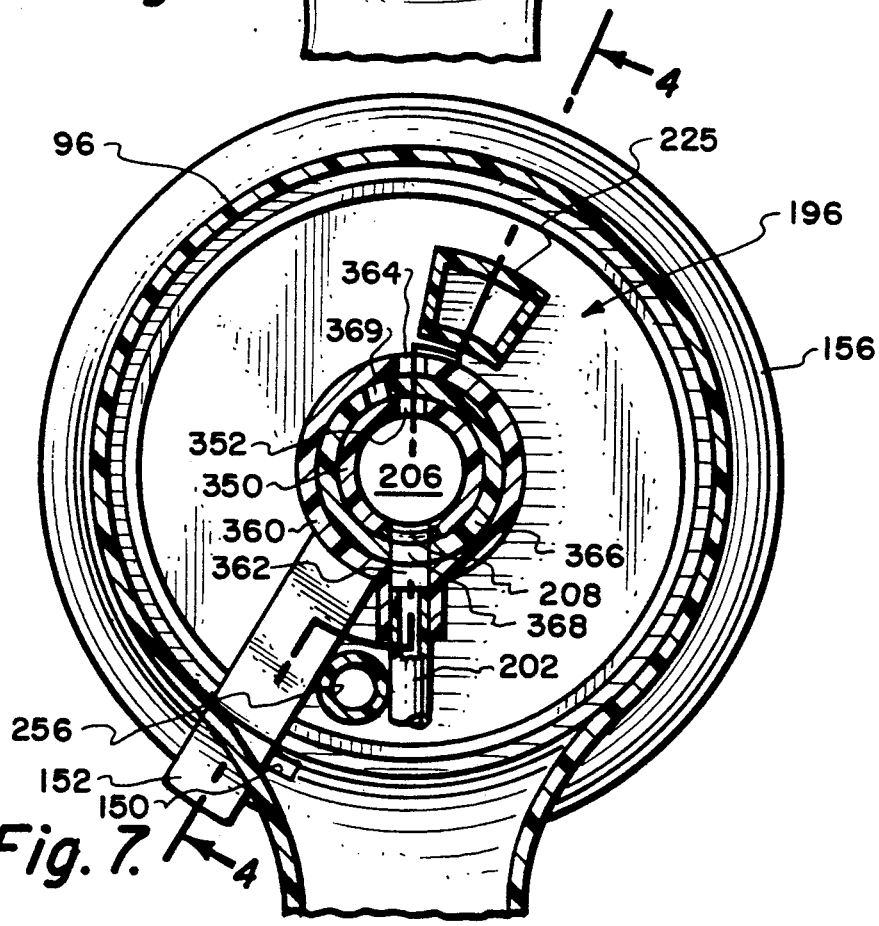
FIG. 7 is a sectional view taken substantially along the plane 7—7 of FIG. 4.

Attention is now directed to FIG. 7 which shows additional detail of the water distribution subassembly 196. From FIG. 4, it can be noted that the cavity 206 is defined by cylindrical wall 350. In addition to the aforementioned air port 208 in wall 350, a tub water port 352 is provided.

Figure 9:
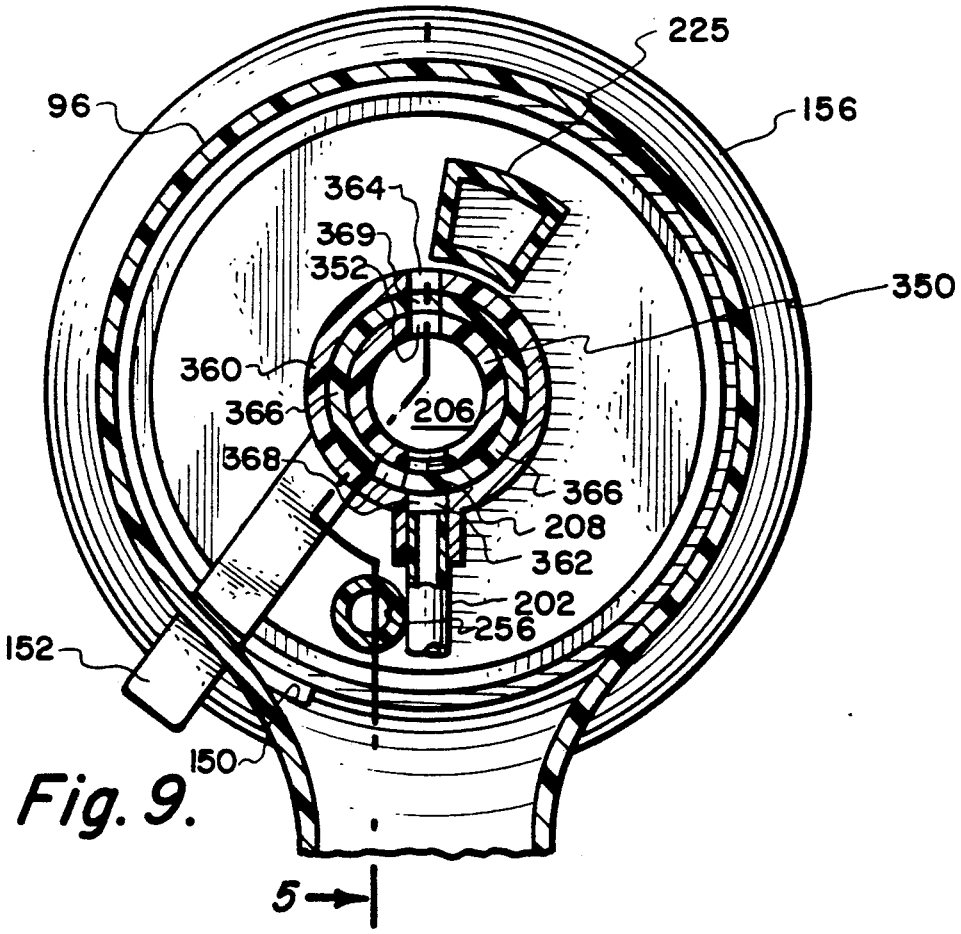
FIG. 9 is a sectional view taken substantially along the plane 9—9 of FIG. 5.

It will be noted in FIGS. 4 and 5 that the cylindrical wall 350 is supported concentrically within an outer support wall 360. Support wall 360 defines an air inlet 362 aligned with air port 208 and a tub water inlet 364 aligned with tub water port 352. A cylindrical valve member 366 is mounted for rotation between cavity wall 350 and support wall 360. The valve member wall 366 is apertured at 368 and 369, annularly space by somewhat less than 180°. The valve member wall 366 can be rotated by the user 24 via handle 152 to align either (1) aperture 368 with air port 208 and air inlet 362 (FIG. 7) or (2) aperture 369 with tub water port 352 and tub water inlet 364 (FIG. 9). Depending upon the rotational position of valve member 366, when the unit is operated in the hydromassage mode to discharge a water stream from mixing tube exit 286 into the cavity 350, it will entrain either air or tub water for discharge through the discharge orifice 140.

Figure 8:
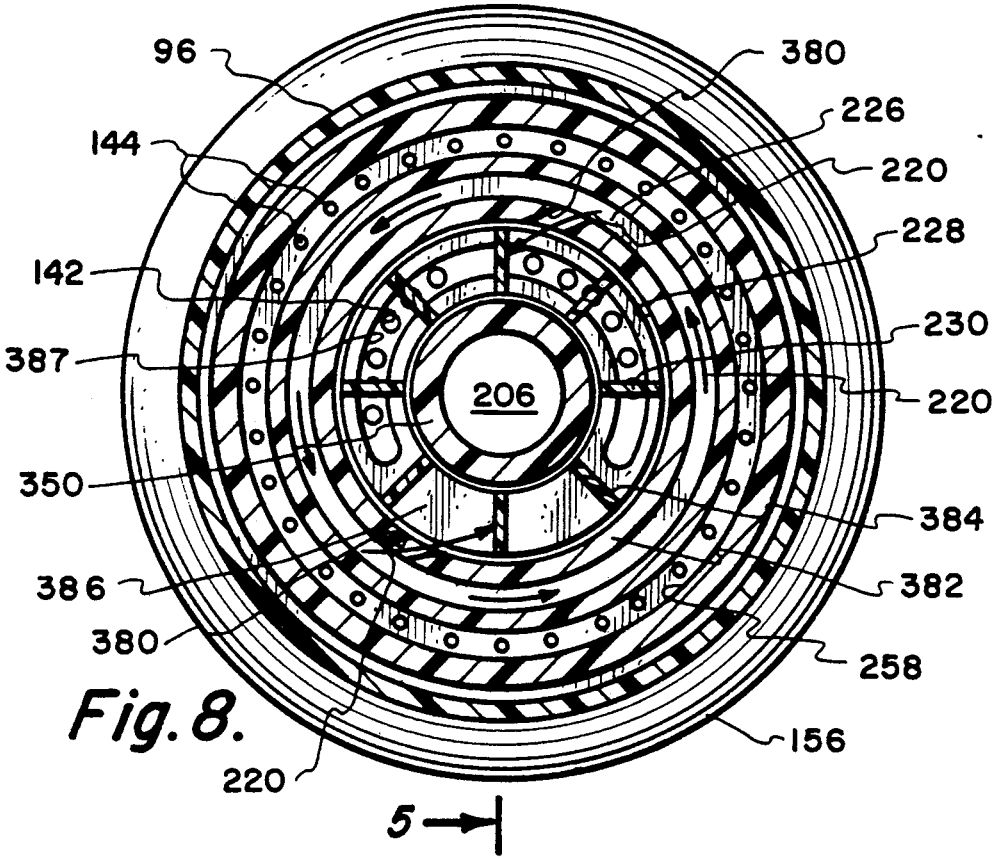
FIG. 8 is a sectional view taken substantially along the plane 8—8 of FIG. 5.

FIG. 8 depicts in greater detail the aforementioned paddle wheel rotor 230 mounted for rotation in compartment 228. Water from the aforementioned tubular member 224 passes through tube 225 and then through manifold 226 into the compartment 228 via tangentially oriented slits 380 in wall 382. This water strikes paddles 384 on the paddle wheel rotor 230 to drive it counter clockwise (as represented in FIG. 8). The paddle wheel rotor 230 includes an annular masking plate 386 and annular opening 387. As the paddle wheel rotor 230 is rotated by the water passing through slits 380, masking plate 386 will periodically block different ones of the pulsed shower openings 142. Thus, the flow out of each of the openings 142 will be periodically interrupted to essentially pulsate the discharged shower stream.

Figures 13, 16:
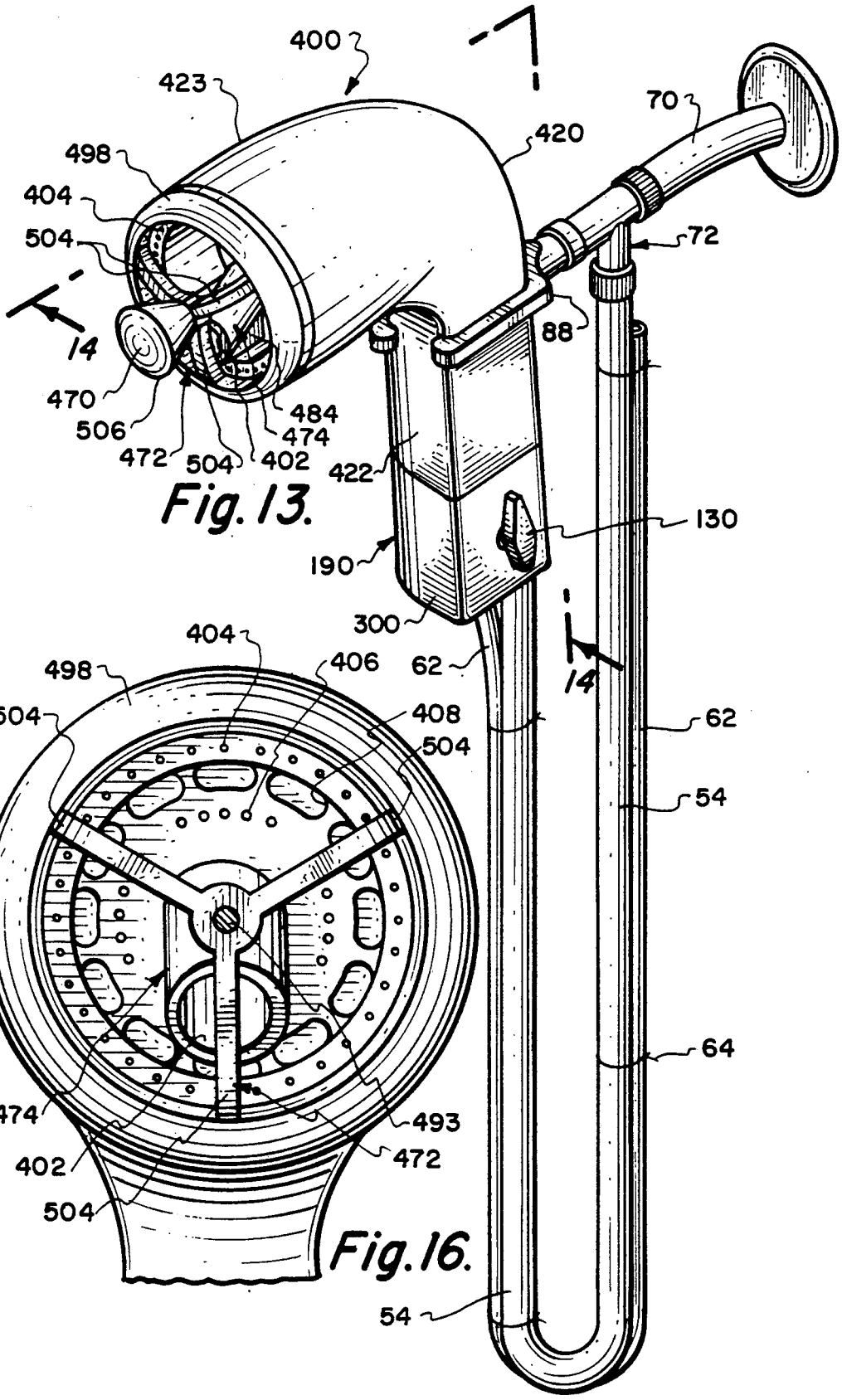
FIG. 13 is an isometric view of an alternative hand held unit in accordance with the present invention.
FIG. 16 is a view taken substantially along the plane 16—16 of FIG. 14.

Attention is now directed to FIGS. 13–18 which illustrate an alternative hand held unit 400 in accordance with the present invention. FIG. 13 depicts the unit 400 installed in the manner of FIG. 2. However, it should be recognized that the unit 400 is just as applicable to the exemplary installation depicted in FIG. 1. The primary feature distinguishing the unit 400 from the aforedescribed unit 40 is that the unit 400 is structured so that its discharge orifice 402 is mounted for movement along a travel path to enable the discharged hydromassage water stream to describe an area on the user's body. In the illustrated configuration, the discharge orifice 402 traverses a circular path having, for example, a radius of approximately 1 inch.

Before discussing the details of the internal construction of unit 400, attention is directed to FIG. 16 which shows a series of small annularly arranged openings 404 which function to discharge a continuous shower spray in accordance with the invention. Openings 406 placed radially inwardly from openings 404, to discharge the pulsating shower spray. Discharge orifice 402, as already mentioned, functions to discharge the hydromassage water stream.

Openings 408, arranged annularly between the continuous shower openings 404 and the pulsator shower openings 406, provides a path for tub water to enter the interior of the unit 400 for suction into the mixing tube of the jet pump, to be described.

The unit 400 is comprised of a housing 420 substantially identical to the previously described housing 180. The lower end of the handle portion 422 thereof accommodates a mode selector valve subassembly which can be identical to the aforedescribed subassembly 190. The differences between the unit 400 and aforedescribed unit 40 reside primarily in the structure of the water distribution subassembly 430.

Figures 14, 17:
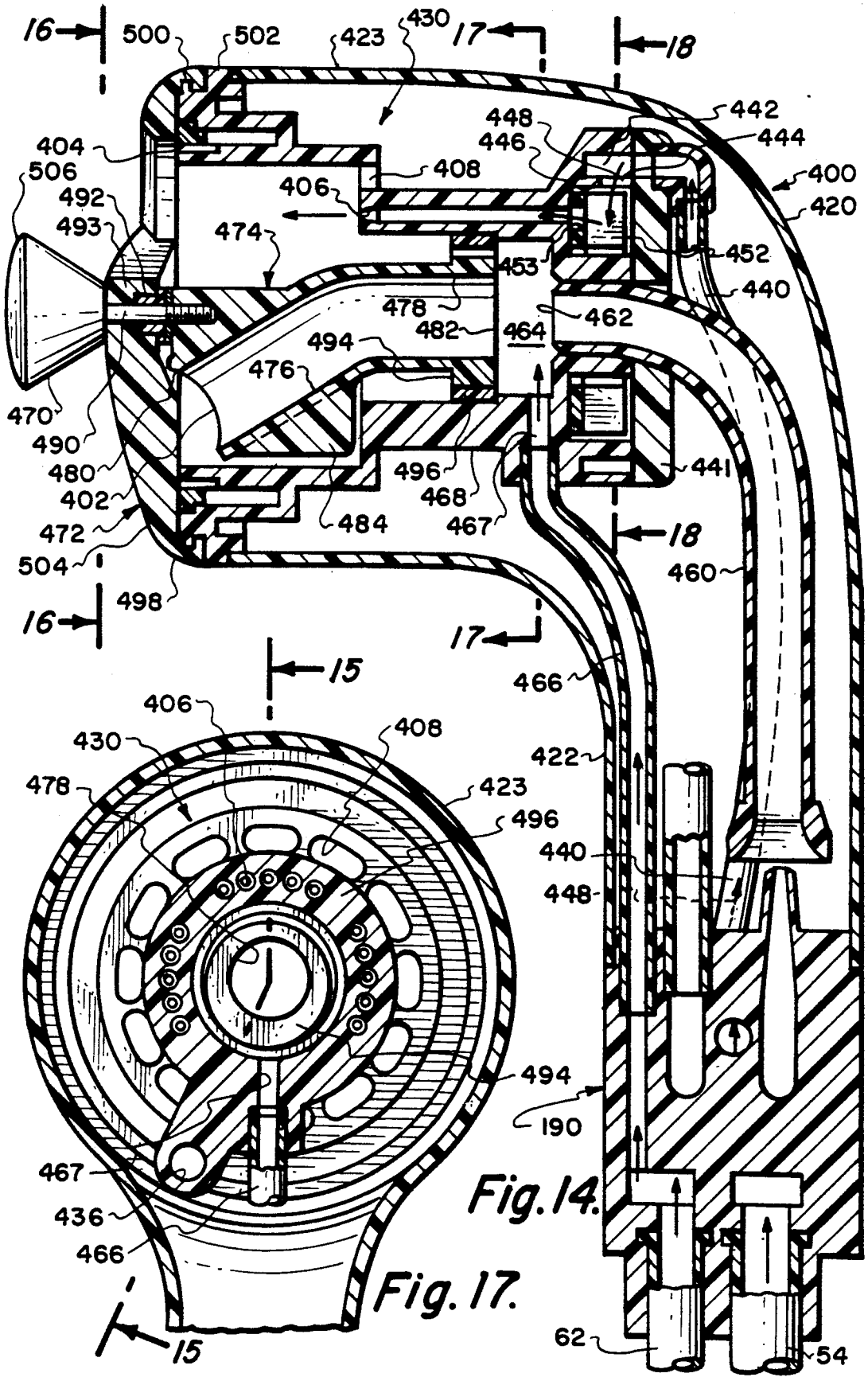
FIG. 14 is a sectional view taken substantially along the plane 14—14 of FIG. 13.
FIG. 17 is a sectional view taken substantially along the plane 17—17 of FIG. 14.
Figures 15, 18:
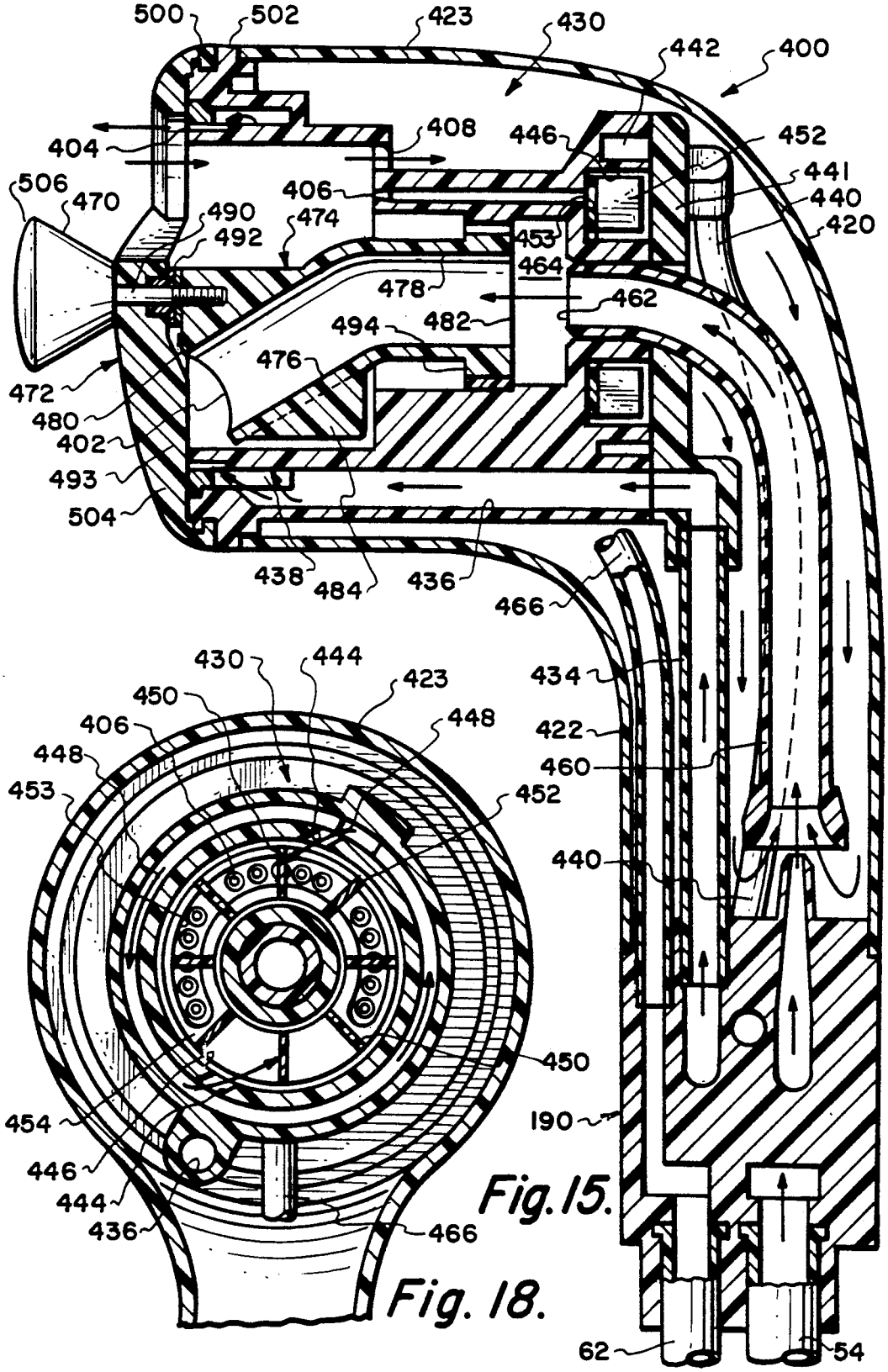
FIG. 15 is a sectional view similar to FIG. 14 but taken along the plane 15—15 of FIG. 17.
FIG. 18 is a sectional view taken substantially along the plane 18—18 of FIG. 14.

As can be seen from FIGS. 14 and 15, when the selector valve 190 selects the continuous shower mode, the fresh tap water from water lumen 54 traverses tubes 434 and 436 for delivery through manifold 438 to openings 404.

When control handle 130 of mode selector valve subassembly 190 selects the pulsed shower mode, the flow from water lumen 54 is directed via tube 440 through back cover 441 to manifold 442 and through tangential slots 444 (FIG. 18) into paddle wheel compartment 446. This water flow represented by arrow 448 strikes paddles 450 to rotate the paddle wheel rotor 452. As in the first disclosed embodiment, i.e. unit 40, this causes the paddle wheel rotor to rotate within the compartment 446. The paddle wheel rotor 452 includes an annular masking plate 454 and annular opening 453. As depicted in FIG. 16 and 17, the openings 406 are preferably arranged in three circumferentially spaced groups. The annular opening 453 extends through an arc of approximately 240°. Thus, when operating in the pulsed shower mode, each opening 406 is open for approximately two thirds of the time.

The jet pump mixing tube 460 is substantially identical to mixing tube 282 of the aforedescribed unit 40 and similarly discharges a water jet at exit 462 into cavity 464. Air tube 466, continuously open to air lumen 62, opens into the cavity 464 via port 467 in cavity wall 468.

The hand held unit 400 further differs from the aforediscussed unit 40 in that it utilizes a single centrally located protuberance 470 configured to mechanically massage a user's body, as will be discussed hereinafter. The unit 400, further differs from the unit 40, as has been mentioned, in that the tub water inlets 408 are arranged peripherally around the head portion 423, rearwardly of an annular front grill 472, upon which the protuberance 470 is mounted.

The unit 400 incorporates a rotatable conduit subassembly 474 which is quite similar to corresponding structure described in FIGS. 14–16 of Applicants' aforecited U.S. Pat. No. 4,715,071 whose disclosure is, by reference, incorporated herein. Basically, the subassembly 474 includes an elongated rigid conduit 476 having a tubular supply section 478 and a tubular discharge section 480. The supply section 478 defines a supply orifice 482 mounted so that its axis is substantially aligned with the exit axis of mixing tube 460. The tubular discharge section 480, which exits into the aforementioned discharge orifice 402, defines an axis misaligned with the axis of supply section 478. A small Drag plate 484 extends substantially radially from the conduit 476. The forward or discharge end of the conduit 476 has a pin 490 staked therein and mounted for rotation in a bearing 492 formed in hub 493 of grill 472. The axis of pin 490 is aligned with the axis of the supply section 478.

The conduit supply section 478 carries a bearing 494 mounted for rotation within a bushing 496. As described in Applicants' U.S. Pat. No. 4,715,071 the outer surface of bearing 494 is preferably eccentrically configured so that it contacts bushing 496 along a very narrow band to minimize friction loss therebetween and to permit the inward flow of tub water into the cavity 464. The orientation of the conduit discharge section 480 causes the stream discharged from orifice 402 to be in a direction having a tangential component which acts to rotate the conduit around an axis defined by pin 490 and bushing 496.

The grill 472 includes an outer ring 498 which is secured, as by a removable bayonet connection 500, to a flange 502 on the water distribution subassembly 430. The grill 472 includes one or more arms 504 extending from ring 498 to hub 493, accommodating the aforementioned bearing 492.

The protuberance 470 is mounted on the hub 493 and extends forwardly therefrom. The protuberance 470 preferably defines a smooth end surface 506 intended to be placed against the user's skin for mechanical massage. More particularly, as the conduit 476 rotates in response to the discharge of the water stream from discharge orifice 402, the stream will produce a reaction force which continually changes direction and causes the head portion 423 to move. By applying firm, but gentle, pressure of the protuberance surface 506 against the user's skin, the protuberance will mechanically massage the user while the water stream discharged from orifice 402 directly provides a hydromassage.

From the foregoing, it should now be appreciated that two embodiments of hand held water discharge units have been disclosed herein, each capable of selective operation in a continuous shower spray mode, a pulsed shower spray mode, and a submergible hydromassage mode. The units both incorporate a liquid jet pump for entraining tub water with supplied pressurized tap water to form a hydromassage water stream for discharge through a fixed or travelling discharge orifice. Means are provided in both units for entraining air into the water stream prior to discharge. In both embodiments, forwardly protecting protuberances are provided to space the discharge orifice from the user's body and thus prevent occlusion of the discharge orifice.

Although two specific embodiments of Applicants' invention are disclosed herein, it is recognized that various structural modifications and equivalents may occur to those skilled in the art and it is accordingly intended that such be included within the scope of the appended claims.

We claim:

1. Apparatus, suitable for use with a water tub having a source supplying pressurized tap water, for discharging a water stream for massaging a user's body, said apparatus comprising:

a housing configured to be held in a user's hand;

a jet pump in said housing having a supply inlet, a suction inlet and, a discharge outlet;

connecting means for coupling said source to said jet pump supply inlet to supply a tap water flow thereto, said connecting means including a flexible hose;

tub water inlet means in said housing for communicating a water pool in said tub with said jet pump suction inlet for entraining tub water with said tap water flow;

discharge orifice means coupling said jet pump discharge outlet exteriorly of said housing for discharging a water stream therefrom for massaging a user's body; and mounting means supporting said discharge orifice for movement along a travel path in response to said water stream being discharged therefrom.

2. The apparatus of claim 1 wherein said connecting means includes adapter means for coupling said source to said flexible hose.

3. The apparatus of claim 2 wherein said adapter means includes unidirectional means for preventing water flow from said hose to said source.

4. The apparatus of claim 2 wherein said adapter means is configured to be coupled to a conventional wall mounted shower pipe functioning as said source of tap water;

said adapter means including bracket means for removably accommodating said housing.

5. The apparatus of claim 2 wherein said adapter means includes a filter.

6. The apparatus of claim 1 including an air source; and means communicating said jet pump discharge outlet with said air source for mixing air into the flow from said discharge outlet.

7. Apparatus, suitable for use with a water tub having a source supplying pressurized tap water, for discharging a water stream for massaging a user's body, said apparatus comprising:

a housing configured to be held in a user's hand;

a jet pump in said housing having a supply inlet, a suction inlet and, a discharge outlet;

connecting means for coupling said source to said jet pump supply inlet to supply a tap water flow thereto, said connecting means including a flexible hose;

tub water inlet means in said housing for communicating a water pool in said tub with said jet pump suction inlet for entraining tub water with said tap water flow;

discharge orifice means coupling said jet pump discharge outlet exteriorly of said housing for discharging a water stream therefrom for massaging a user's body; and protuberance means mounted on said housing adapted to engage a user's body for spacing said discharge orifice therefrom to prevent occlusion of said water stream.

8. The apparatus of claim 7 wherein said discharge orifice is supported for movement along a travel path in response to said water stream being discharged therefrom; said discharged water stream producing a reaction force on said housing to move said protuberance means; and wherein said protuberance means has a substantially smooth surface for engaging said user's body to mechanically massage said user.

9. Apparatus, suitable for use with a water tub having a source supplying pressurized tap water, for discharging a water stream for massaging a user's body, said apparatus comprising:

a housing configured to be held in a user's hand;

a jet pump in said housing having a supply inlet, a suction inlet and, a discharge outlet;

connecting means for coupling said source to said jet pump supply inlet to supply a tap water flow thereto, said connecting means including a flexible hose;

tub water inlet means in said housing for communicating a water pool in said tub with said jet pump suction inlet for entraining tub water with said tap water flow;

discharge orifice means coupling said jet pump discharge outlet exteriorly of said housing for discharging a water stream therefrom for massaging a user's body; and said connecting means including an adapter means for coupling said source to said flexible hose;

said adapter means including a unidirectional means for preventing water flow from said hose to said source;

said hose having a first end connected to said housing; and wherein said adapter means includes a substantially closed container for accommodating said hose to collect water drippings therefrom; and means mounting said hose for permitting a portion thereof led by said first end to be withdrawn from and returned to said container.

10. Apparatus, suitable for use with a water tub having a source supplying pressurized tap water, for discharging a water stream for massaging a user's body, said apparatus comprising:

a housing configured to be held in a user's hand;

a jet pump in said housing having a supply inlet, a suction inlet, and a discharge outlet;

connecting means for coupling said source to said jet pump supply inlet to supply a tap water flow thereto, said connecting means including a flexible hose;

tub water inlet means in said housing for communicating a water pool in said tub with said jet pump suction inlet for entraining tub water with said tap water flow;

a cavity defined in said housing;

said jet pump discharge outlet exiting to said cavity for discharging a water jet to produce a suction in said cavity;

air source means communicating with said cavity for supplying air thereto drawn by said suction;

means communicating with said cavity defining a discharge orifice for discharging a water stream therefrom into said water pool; and mounting means supporting said discharge orifice for movement along a travel path in response to said water stream being discharged therefrom.

11. The apparatus of claim 10 wherein said connecting means includes adapter means for coupling said source to said flexible hose.

12. The apparatus of claim 11 wherein said adapter means includes unidirectional means for preventing water flow from said hose to said source.

13. The apparatus of claim 11 wherein said adapter means is configured to be coupled to a conventional wall mounted shower pipe functioning as said source of tap water;

said adapter means including bracket means for removably accommodating said housing.

14. Apparatus, suitable for use with a water tub having a source supplying pressurized tap water, for discharging a water stream for massaging a user's body, said apparatus comprising:

a housing configured to be held in a user's hand;

a jet pump in said housing having a supply inlet, a suction inlet, and a discharge outlet;

connecting means for coupling said source to said jet pump supply inlet to supply a tap water flow thereto, said connecting means including a flexible hose;

tub water inlet means in said housing for communicating a water pool in said tub with said jet pump suction inlet for entraining tub water with said tap water flow;

a cavity defined in said housing;

said jet pump discharge outlet exiting to said cavity for discharging a water jet to produce a suction in said cavity;

air source means communicating with said cavity for supplying air thereto drawn by said suction;

means communicating with said cavity defining a discharge orifice for discharging a water stream therefrom into said water pool; and protuberance means mounted on said housing adapted to engage a user's body for spacing said discharge orifice therefrom to prevent occlusion of said water stream.

15. The apparatus of claim 14 wherein said discharge orifice is supported for movement along a travel path in response to said water stream being discharged therefrom; said discharged water stream producing a reaction force on said housing to move said protuberance means; and wherein said protuberance means has a substantially smooth surface for engaging said user's body to mechanically massage said user.

16. Apparatus, suitable for use with a water tub having a source supplying pressurized tap water, for discharging a water stream for massaging a user's body, said apparatus comprising:

a housing configured to be held in a user's hand;

a jet pump in said housing having a supply inlet, a suction inlet, and a discharge outlet;

connecting means for coupling said source to said jet pump supply inlet to supply a tap water flow thereto, said connecting means including a flexible hose;

tub water inlet means in said housing for communicating a water pool in said tub with said jet pump suction inlet for entraining tub water with said tap water flow;

a cavity defined in said housing;

said jet pump discharge outlet exiting to said cavity for discharging a water jet to produce a suction in said cavity;

air source means communicating with said cavity for supplying air thereto drawn by said suction;

means communicating with said cavity defining a discharge orifice for discharging a water stream therefrom into said water pool;

said connecting means including an adapter means for coupling said source to said flexible hose;

said adapter means including a unidirectional means for preventing water flow from said hose to said source;

said hose having a first end connected to said housing; and wherein said adapter means includes a substantially closed container for accommodating said hose to collect water drippings therefrom; and means mounting said hose for permitting a portion thereof led by said first end to be withdrawn from and returned to said container.

17. Apparatus, suitable for use with a water tub having a source supplying pressurized tap water, for selectively discharging a shower water spray or a hydromassage water stream for massaging a user's body underwater, said apparatus comprising:

a housing configured to be held in a user's hand, said housing defining a water supply inlet, a tub water inlet, a plurality of shower outlets, and a hydromassage discharge orifice;

connecting means for coupling said source to said water supply inlet, said connecting means including a flexible hose having a first end connected to said housing;

a jet pump in said housing having a supply entrance, a suction entrance, and a discharge exit;

means communicating with said tub water inlet for supplying tub water to said jet pump suction entrance when said tub water inlet is submerged in a water pool in said water tub to produce a combined water/tap water flow at said discharge exit;

a conduit communicating said jet pump discharge exit to said hydromassage discharge orifice; and user operable selector valve means in said housing for selectively coupling said water supply inlet to (1) said shower outlets for discharging a shower water spray therefrom or (2) said jet pump supply entrance for discharging a hydromassage water stream from said discharge orifice comprising a mixture of supplied tap water and tub water.

18. The apparatus of claim 17 including water driven means for periodically interrupting said shower water spray.

19. The apparatus of claim 17 wherein said discharge orifice is supported for movement along a travel path in response to said water stream being discharged therefrom.

20. The apparatus of claim 17 further including:

protuberance means mounted on said housing adapted to engage a user's body for spacing said discharge orifice therefrom to prevent occlusion of said water stream.

21. The apparatus of claim 17 wherein said discharge orifice is supported for movement along a travel path in response to said water stream being discharged therefrom; said discharged water stream producing a reaction force on said housing to move said protuberance means; and wherein said protuberance means has a substantially smooth surface for engaging said user's body to mechanically massage said user.

22. The apparatus of claim 17 wherein said connecting means includes adapter means for coupling said source to said flexible hose.

23. The apparatus of claim 22 wherein said adapter means includes unidirectional means for preventing water flow from said hose to said source.

24. The apparatus of claim 22 wherein said hose includes a first end connected to said housing; and wherein said adapter means includes a substantially closed container for accommodating said hose to collect water drippings therefrom; and means mounting said hose for permitting a portion thereof led by said first end to be withdrawn from and returned to said container.

25. The apparatus of claim 17 wherein said means communicating said jet pump discharge exit to said discharge orifice includes a cavity; and air source means communicating with said cavity for supplying air thereto for mixing with the tub water/tap water flow produced by said jet pump at said discharge exit.

26. In combination:

water discharge means including a housing configured to be held in a user's hand, said housing defining a supply inlet and a discharge outlet;

a flexible hose having a first end coupled to said supply inlet and a second end adapted to be coupled to a water source;

a container defining an opening having a mouth adapted to be suspended from a horizontal deck around a hole in said deck; and means mounting at least a portion of said hose in said container accommodating said first end for movement through said mouth into and out of said container whereby water drippings from said hose will collect in said container.

27. The combination of claim 26 wherein said container comprises a bag formed of flexible material.

* * * * *